US005117803A

United States Patent [19]

Johnson

[11] Patent Number: 5,117,803

[45] Date of Patent: Jun. 2, 1992

[54] ADJUSTABLE ARROW REST

[76] Inventor: Steven C. Johnson, 460 Wood Ave., Eugene, Oreg. 97402

[21] Appl. No.: 587,112

[22] Filed: Sep. 24, 1990

[51] Int. Cl.[5] ..... F41B 5/22

[52] U.S. Cl. ..... 124/44.5; 124/24.1

[58] Field of Search ..... 124/44.5, 24.1, 88, 124/41.1

[56] References Cited

U.S. PATENT DOCUMENTS

| | | | |
|---|---|---|---|
| 3,865,096 | 2/1975 | Troncoso, Jr. | 124/24.1 |
| 3,871,352 | 3/1975 | Stanislawski et al. | 124/44.5 |
| 4,332,232 | 6/1982 | Troncoso, Jr. | 124/44.5 X |
| 4,476,846 | 10/1984 | Carville | 124/44.5 |
| 4,489,704 | 12/1984 | Troncoso, Jr. | 124/44.5 X |
| 4,569,325 | 2/1986 | Christian | 124/44.5 |
| 4,686,956 | 8/1987 | Troncoso, Jr. | 124/44.5 |
| 4,827,895 | 5/1989 | Troncoso, Jr. | 124/44.5 |
| 4,838,237 | 6/1989 | Cliburn | 124/44.5 |
| 4,899,716 | 2/1990 | Martin et al. | 124/44.5 |
| 4,919,115 | 4/1990 | Miller | 124/24.1 |

*Primary Examiner*—Peter M. Cuomo

[57] ABSTRACT

An adjustable arrow rest including a mounting plate having a plurality of threaded apertures to facilitate securement to an archery bow. An L-shaped slide block is mounted for reciprocal linear adjustment in a vertical direction on the mounting plate by a first pair of cooperating dovetail guide members. A housing block is mounted for reciprocal linear adjustment in a horizontal direction along a second leg of the slide block by a second pair of cooperating dovetail guide members. The first and second pair of dovetail guide members are each provided with a worm drive screw to effect precise independent micro-adjustment in vertical and horizontal directions. A rotary sleeve is mounted for rotation within a cylindrical bore formed through the housing block. A torsional coil spring surrounds the sleeve and provides a rotational spring bias thereto. A support of an arrow rest support blade or arm is secured within the rotary sleeve. The arrow rest support blade is rotatable in a downward direction under the force of an arrow against the restorative spring bias of the torsional coil spring. The torsional coil spring may be wound in discrete angular increments by a spring adjusting wheel to vary the spring tension to accommodate various different arrow sizes and weights, bow weights and individual techniques.

66 Claims, 6 Drawing Sheets

ADJUSTABLE ARROW REST

BACKGROUND OF THE INVENTION

The present invention relates to adjustable arrow rests, and more particularly pertains to an improved adjustable arrow rest which allows precise micro-adjustment of an arrow rest support blade independently in vertical and horizontal directions within the arrow window of an archery bow or in an overdraw attachment. Equipment for the sport of archery has become more sophisticated and technical, particularly when related to and used in target shooting competition. Modern day equipment advances include the compound bow, mechanical trigger releases for the bow string, intricate sighting devices, and overdraw attachments which serve to increase efficiency, arrow speeds and accuracy. However, despite all these improvements, inconsistencies continue to occur due to variations and mechanical changes in the bow, arrow rest and related equipment.

The term archer's paradox, or bending of the arrow upon release of the bow string, is another phenomena which adversely affects and contorts the arrow as it leaves the bow. The forces exerted upon the rearward portion of the arrow shaft compress and buckle the shaft as it is pushed by the bow string. The resulting horizontal oscillations or "fish-tailing" flight of an arrow upon release is greatly accentuated when the arrow is sitting off center or is slightly misaligned with the line of force. Therefore, it is desireable to produce an arrow rest that is precisely adjustable and can be positively locked in a selected adjusted position. Additionally, an arrow rest should be precisely returnable to previous settings when changing between various bow weights or different arrows.

The support blade of an arrow rest also should not collide with the arrow shaft or interfere with the arrow feathers or vanes. Since the arrow shaft buckles in a vertical direction, as well as the horizontal direction when it is released, the support blade should ideally yield so as not to cause the arrow shaft to bump against it and so as to permit the arrow vanes to clear freely without striking against it. Consequently, the premier arrow rests currently available are provided with a support blade that deflects downwardly under spring resistance so as not to interfere with the arrow vanes and so as to resistively cushion downward movement and vertical oscillations of the arrow shaft. Such arrow rests usually automatically return the support blade to its desired initial position after the entire arrow has passed the arrow rest so that a second arrow may be placed on the rest for another shot. The optimum resistive downward deflection varies with different arrow sizes and weights, bow weights and individual technique. The present invention relates to controlling the resistance with precision.

SUMMARY OF THE INVENTION

In order to achieve these and other objects of the invention, the present invention provides an improved adjustable arrow rest which includes a mounting plate having a plurality of threaded apertures to facilitate securement to an archery bow. An L-shaped slide block is mounted for reciprocal linear adjustment in a vertical direction on the mounting plate by a first pair of cooperating dovetail guide members. A housing block is mounted for reciprocal linear adjustment in a horizontal direction along a second leg of the slide block by a second pair of cooperating dovetail guide members. The first and second pair of dovetail guide members are each provided with a worm drive screw to effect precise independent micro-adjustment in vertical and horizontal directions. A rotary sleeve is mounted for rotation within a cylindrical bore formed through the housing block. A torsional coil spring surrounds the sleeve and provides a rotational spring bias thereto. A support shaft of an arrow rest support blade or arm is secured within the rotary sleeve. The arrow rest support blade is rotatable in a downward direction under the force of an arrow against the restorative spring bias of the torsional coil spring. The torsional coil spring may be wound in discrete angular increments by a spring adjusting wheel to vary the spring tension to accommodate various different arrow sizes and weights, bow weights and individual technique.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT(S)

Figure 1:
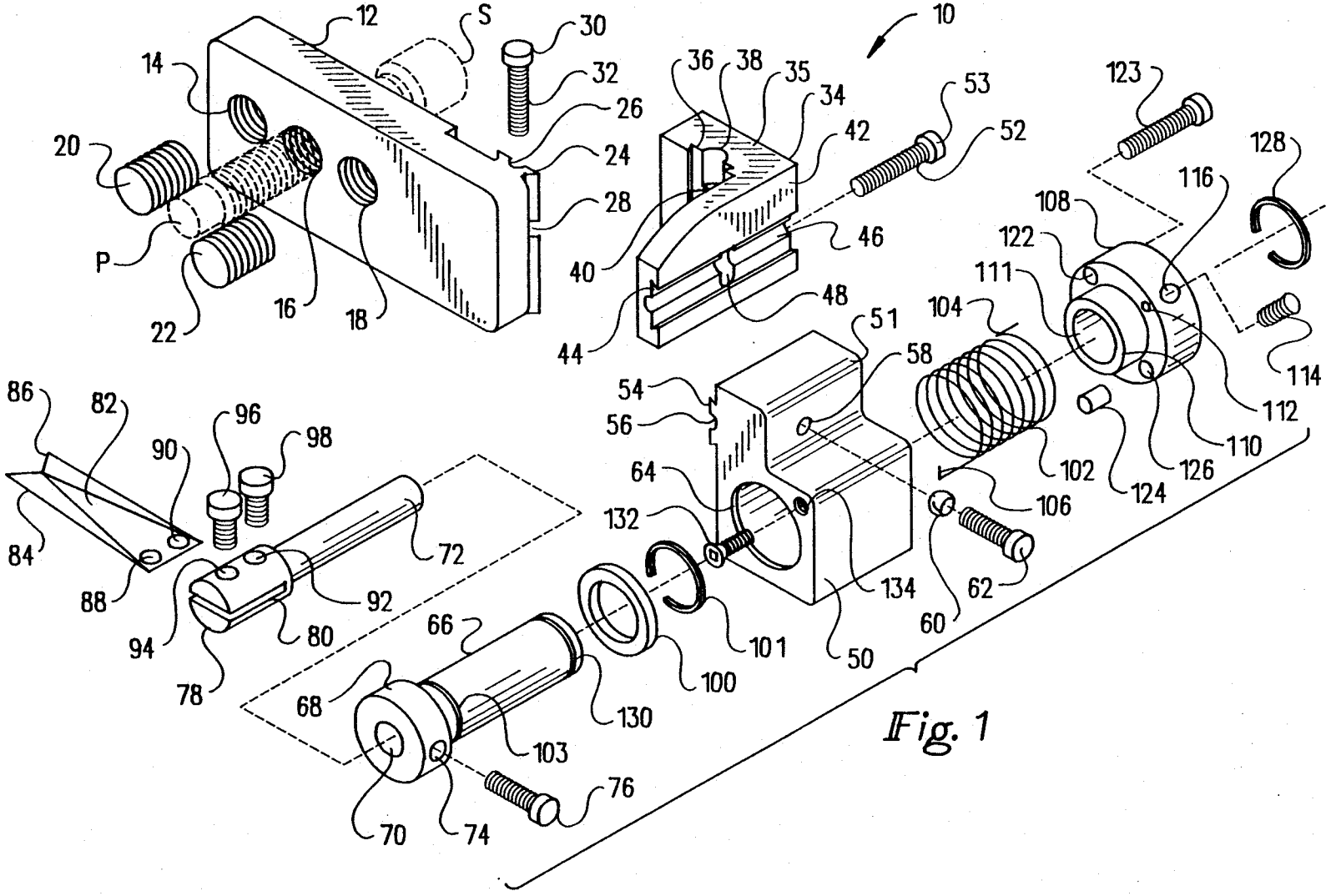
FIG. 1 is an exploded perspective view of the adjustable arrow rest according to the present invention.
Figure 8:
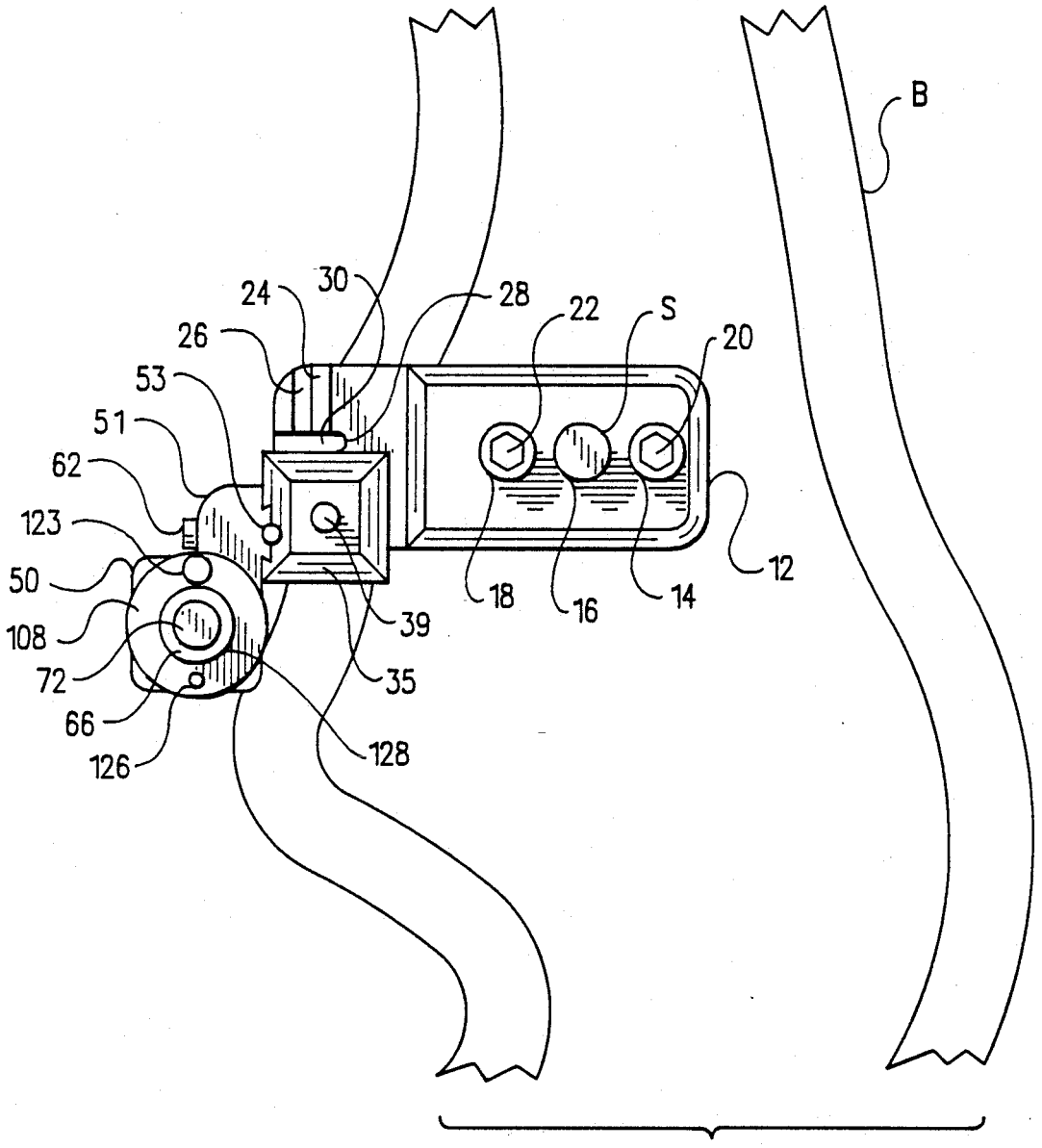
FIG. 8 is a right side elevational view illustrating the adjustable arrow rest of the present invention secured on an archery bow.

Referring now to the drawings, wherein like reference numerals designate corresponding structure throughout the views, and referring in particular to FIG. 1, an improved adjustable arrow rest 10 according to a first preferred embodiment of the invention includes a mounting plate 12 having three threaded apertures 14, 16 and 18, disposed in a linear array. The apertures 14, 16, and 18 are dimensioned to receive a threaded shank portion of a securement screw S. The screw S may be disposed in the central aperture 16, and may be of the type having a spring biased plunger portion P, as disclosed in U.S. Pat. No. 3,865,096, the entire disclosure of which is herein incorporated by reference. A pair of set screws 20 and 22 are engageable in the remaining two apertures in the mounting plate 12, for example in the outer apertures 14 and 18. To secure the mounting plate 12 to a vertical side wall of a handle portion of an archery bow, the screw S is inserted through the aperture 16, or one of the apertures 14, 18, and into threaded engagement with an aperture provided in the bow handle portion. As shown in FIG. 8, the set screws 20 and 22 are then inserted through the two remaining threaded apertures in the mounting plate 12 and tightened into abutment with the bow handle side wall portion, to prevent any angular slippage of the mounting plate 12 about the axis of the screw S.

Figure 2:
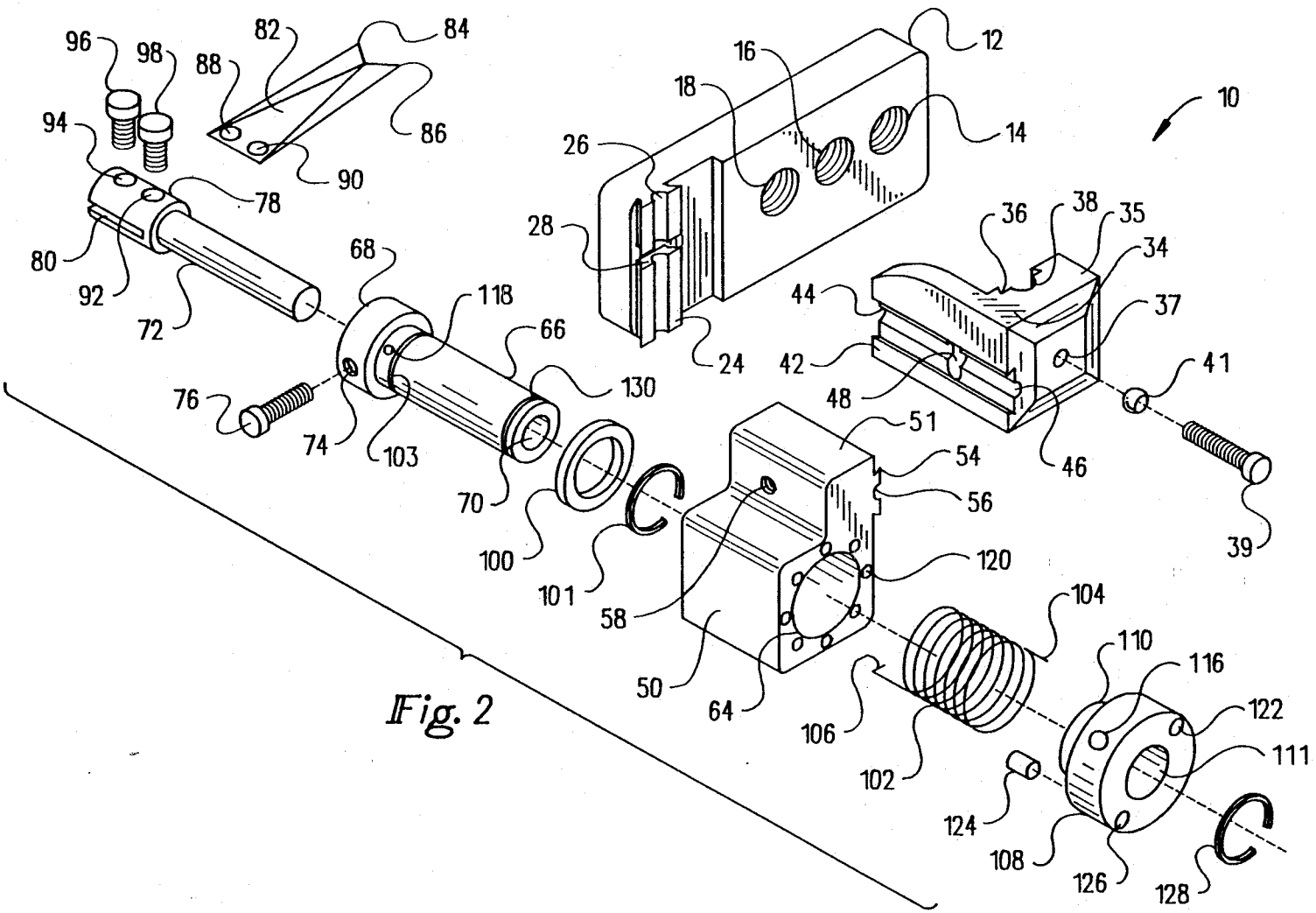
FIG. 2 is an exploded, different perspective view further illustrating the adjustable arrow rest of the present invention.
Figure 4:
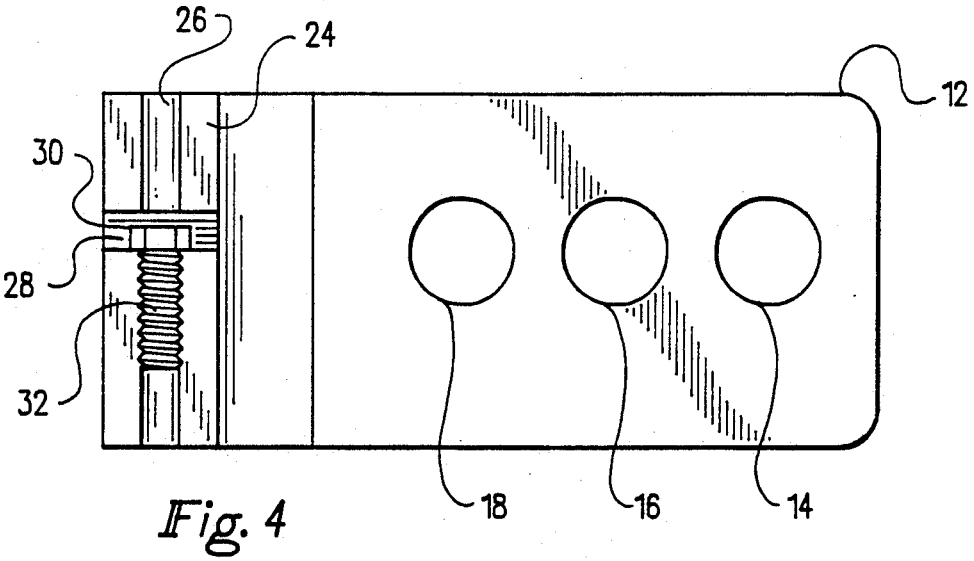
FIG. 4 is a side elevational view illustrating the mounting plate of the adjustable arrow rest of the present invention.

As seen in FIGS. 1, 2, and 4, a first male dovetail guide member 24 is formed adjacent one end of the mounting plate 12. An elongated non-threaded central recess extends along the dovetail guide member 24, and is divided by a recessed slot 28. A worm drive screw includes an enlarged head portion 30 and a threaded shank 32, as depicted in FIGS. 1 and 4. The head portion 30 is dimensioned to be captured in the recessed slot 28 in a manner to allow rotation of the screw, but prevent axial displacement relative to the dovetail member 24.

The adjustable arrow rest 10 also includes an L-shaped slide block 34 having a first shorter leg 35 and a second longer leg 42, the legs 35, 42 being oriented substantially orthogonally to each other. A female dovetail guide member 36 is formed on the leg 35 and is dimensioned for engagement with the male dovetail guide member 24 on the mounting plate 12. It should be understood that this construction can be reversed, such that the male dovetail member is disposed on the leg 35 and the female dovetail guide member is disposed on the plate 12, without departing from the scope of the present invention. Additionally, while the preferred embodiment of the invention is disclosed and described in connection with the use of dovetail type guide members, it should be understood that a variety of other linear slide configurations, for example, T-slot guides, may be employed within the teachings of the invention. An elongated central semi-cylindrical recess is formed in the dovetail guide member 36 and includes a larger diameter non-threaded portion 38 and a smaller diameter threaded portion 40, as best illustrated in FIG. 3.

In an assembled condition, the threads 32 of the worm drive screw are disposed in an engagement with the threaded portion 40 of the recess in the dovetail guide member 36. Because the head of the worm drive screw 30 is captured against axial movement in the recessed slot 28, as depicted in FIG. 4, rotation of the threads 32 effects a linear translation of the L-shaped slide block 34 along the dovetail guide member 24. By rotation of the screw head 30 in a selected direction, a precise reciprocal linear adjustment of the block 34 in a vertical direction may be effected.

Figure 3:
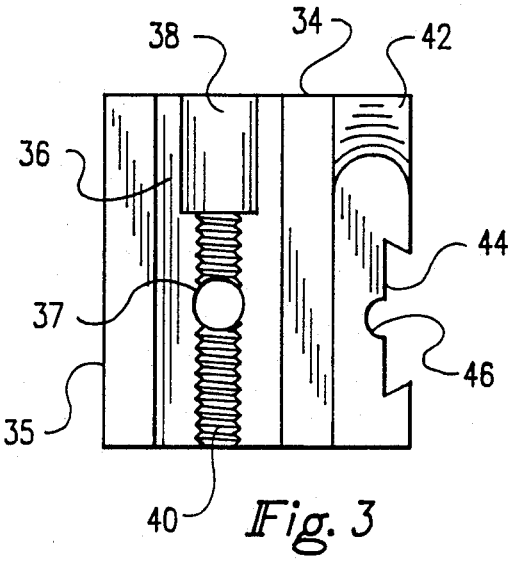
FIG. 3 is a side elevational view illustrating the dovetail guide members of the L-shaped slide block of the adjustable arrow rest of the present invention.

In order secure the dovetail guide member 36 on the shorter leg portion 35 of the L-shaped slide block 34 in a selected adjusted position along the dovetail guide member 24 formed on the mounting plate 12, a transverse threaded aperture 37 is formed through a side wall of the shorter leg 35, as shown in FIGS. 2 and 3. In an assembled condition, the enlarged head portion 30 of the worm drive screw is received within the enlarged non-threaded recess 38 (FIG. 3) of the dovetail guide member 36. A nylon packing disk or pellet 41 (FIG. 2) is inserted into the aperture 37 and pressed against the threaded shank 32 (FIG. 1) of the worm drive screw by a clamping set screw 39. It should be understood that the threaded aperture 37 and clamping screw 39 may be disposed through the mounting plate 12 instead of the leg 35, without departing from the scope of the present invention. The deformable material of the packing disk 41 allows conformance with the threads 32, thus preventing any thread damage. Tightening of the screw 39 also forces a clamping engagement of the dovetail guide members 24 and 36, thus securing the L-shaped slide block 34 in a selected vertically adjusted position with respect to the mounting plate 12. Upon loosening of the clamping set screw 39, the now deformed packing disk 41 continues to exert a frictional force on the screw threads 32, thus providing a resistance to linear translation of the L-shaped slide block 34, eliminating undesirable free-play. This allows extremely precise adjustments of the block 34 along the dovetail guide member 24. While a nylon material for the packing disk 41 is preferred, similar deformable materials may be employed.

Figure 5:
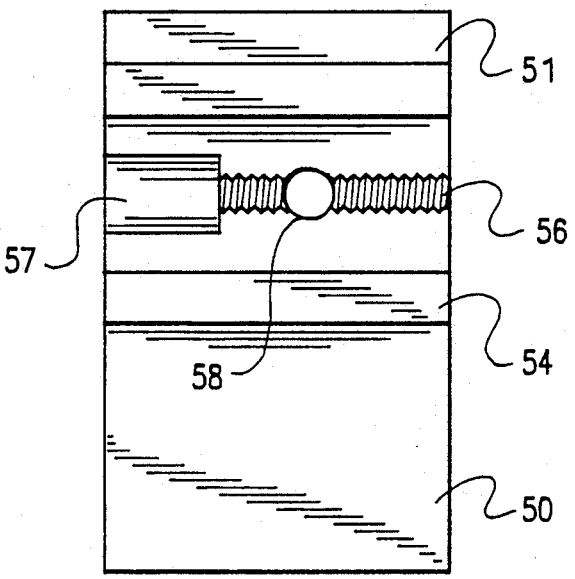
FIG. 5 is a side elevational view illustrating the dovetail guide portion of the housing block of the adjustable arrow rest of the present invention.

The longer leg portion 42 of the block 34 is provided with a female dovetail guide member 44 having an elongated central semi-cylindrical recess 46 which is divided by a recessed slot 48. A housing block 50 has a generally rectangular configuration and includes an extension portion 51 provided with a male dovetail guide member 54 dimensioned for cooperating engagement with the dovetail guide member 44 on the block leg 42. As best seen in FIG. 5, the dovetail guide member 54 includes an elongated central semi-cylindrical recess having a smaller diameter threaded portion 56 and a coaxial larger diameter non-threaded portion 57. Rotation of the screw head 53 with the screw threads 52 in engagement with the threaded recess 56 thus imparts a linear motion to the housing block 50 along the dovetail guide member 44.

A transverse threaded aperture 58 is formed through the extension member 51 and communicates with the threaded semi-cylindrical recess 56, as shown in FIG. 5. As shown in FIG. 1, A nylon packing disk or pellet 60 is dimensioned for insertion into the aperture 58. A clamping screw 62 is dimensioned for threaded engagement in the aperture 58, such that tightening of the screw 62 forces the packing disk or pellet 60 against the threads 52 of the worm drive screw. The deformable material of the packing disk 60 allows conformance with the threads 52, thus preventing any thread damage. Tightening of the screw 62 also forces a clamping engagement of the dovetail guide members 44 and 54, thus securing the housing block 50 in a selected adjusted position. Upon loosening of the clamping set screw 62, the now deformed packing disk 60 continues to exert a frictional force on the screw threads 52, thus providing a resistance to linear translation of the housing block 50, eliminating undesirable free-play. This allows extremely precise adjustments of the block 50 along the dovetail guide member 44. While a nylon material for the packing disk 60 is preferred, similar deformable materials may be employed.

A cylindrical bore 64 is formed through the housing block 50, in a directional parallel to the longitudinal axis of the dovetail guide member 54. A rotary cylindrical sleeve 66 is received for rotation within the bore 64. The sleeve 66 includes an enlarged diameter portion 68 formed at an outer external end. An axial cylindrical bore 70 is formed through the sleeve 66 and is dimensioned for insertion of an arrow rest support shaft 72. A transverse threaded aperture 74 is formed in a radial direction through the wall of the enlarged diameter sleeve portion 68 and into communication with the bore 70. A set screw 76 cooperates with the aperture 74 to secure the arrow rest support shaft 72 in a selected axially and rotationally adjusted position with respect to the sleeve 66. An arrow rest blade clamping head 78 is formed at a distal end of the support shaft 72 and includes a slot 80, forming a bifurcated clamping head portion. The lower longitudinal end of an arrow rest support blade or arm 82 is inserted into the slot 80. The blade 82 includes a triangular floor portion bordered by obliquely inclined triangular side wall portions 84 and 86. A pair of apertures 88 and 90 on the blade 82 are disposed in alignment with threaded apertures 92 and 94 formed through the clamping head 78. Screws 96 and 98 are inserted through the aligned apertures 88, 90, 92 and 94, thus tightening the slotted clamping head 78 into secure clamping engagement with the support blade 82. It should be noted that arrow rest support blades are available in a variety of different configurations which may be employed in conjunction with the teachings of the present invention.

To provide a play-free rotational mounting of the rotary sleeve 66 within the housing block 50, a brass bushing 100 is received on the sleeve 66. The bushing 100 is dimensioned for a press fit within the bore 64, such that the sleeve 66 rotates within the bushing 100. As shown in FIG. 2, an annular groove 103 adjacent the enlarged diameter portion 68 of the sleeve 66 is dimensioned for reception of a snap ring 101. The bushing 100 is thus captured against axial displacement along the sleeve 66 between the annular shoulder of the larger diameter portion 68 and the snap ring 101.

A torsional coil spring 102 has a straight free end portion 104 and an opposite right angular free end portion 106. The torsional coil spring 102 surrounds the sleeve 66 and is received within the bore 64 of the housing block 50. As illustrated in FIG. 2, the right angular end portion 106 is inserted within a small aperture 118 formed in a radial direction in the rotary sleeve 66. Thus, rotation of the sleeve 66 effects a winding of the spring 102, producing a restorative spring bias force.

A spring tension adjusting wheel 108 is in the form of a stepped cylindrical disk having a reduced diameter bushing portion 110 dimensioned for insertion into the bore 64 formed in the housing block 50. As shown in FIG. 1, a small hole 112 is formed on an annular inner surface of the adjusting wheel 108, and is dimensioned for insertion of the straight spring free end 104. A set screw 114 cooperates with a threaded aperture 116 to secure the spring end !04 within the aperture 112. By virtue of this arrangement, the rotary tension of the coil spring 102 may be adjusted by rotation of the wheel or dial 108, thus effecting a winding of the torsional coil spring 102. The physical length of the spring 102 is slightly shorter than the length of the bore 64 in the housing block 50, for the purpose of providing an axial tension to retain the components in an assembled condition. By replacement of the spring 102 with a spring of a different size or material, a wide variety of different spring tension ranges may be provided.

As shown in FIG. 2, a plurality of threaded apertures !20 are disposed in a circular array about a central longitudinal axis of the cylindrical bore 64 formed through the housing block 50. In the illustrated embodiment, eight apertures 120 are spaced at uniform angular increments around the bore 64. The number of apertures 120 may, of course, be greater or less than eight. A threaded aperture 122 formed in an axial direction through the adjusting wheel 108 is disposed for alignment with the circularly arrayed apertures 122, and dimensioned for reception of an index position clamping screw 123 (FIG. 1). Engagement of the clamping screw 123 in a selected one of the threaded apertures 120 secures the spring adjusting wheel or dial 108 in a selected rotationally indexed position. To facilitate the retention and selection of a selected rotary index position, a dowel or locating pin 124 is received within an axial aperture 126 formed through the adjusting wheel 108. By positioning the dowel or locating pin 124 in a selected one of the apertures 120 in the housing block 50, the wheel 108 may be retained in a selected position prior to insertion and tightening of the clamping screw 123 (FIG. 1). The spring 102 provides an axial tension force which facilitates insertion of the pin 124 in a selected one of the apertures 120. As can now be readily appreciated, the wheel or dial 108 provides reregistrable adjustment of the spring bias, such that the spring bias may be selectively changed from one magnitude to a second, different magnitude and then back to substantially exactly the first magnitude.

The smaller diameter end portion of the rotary sleeve 66 is received for rotation within an axial bore 111 formed through the spring adjusting wheel 108. A snap ring 128 is engageable within an annular groove 130 formed around the smaller diameter end portion of the sleeve 66. The snap ring 128 serves to retain the components in an axially assembled condition, preventing the wheel 108 from being pulled off the sleeve 66 when spring tension adjustments are performed.

Figure 6:
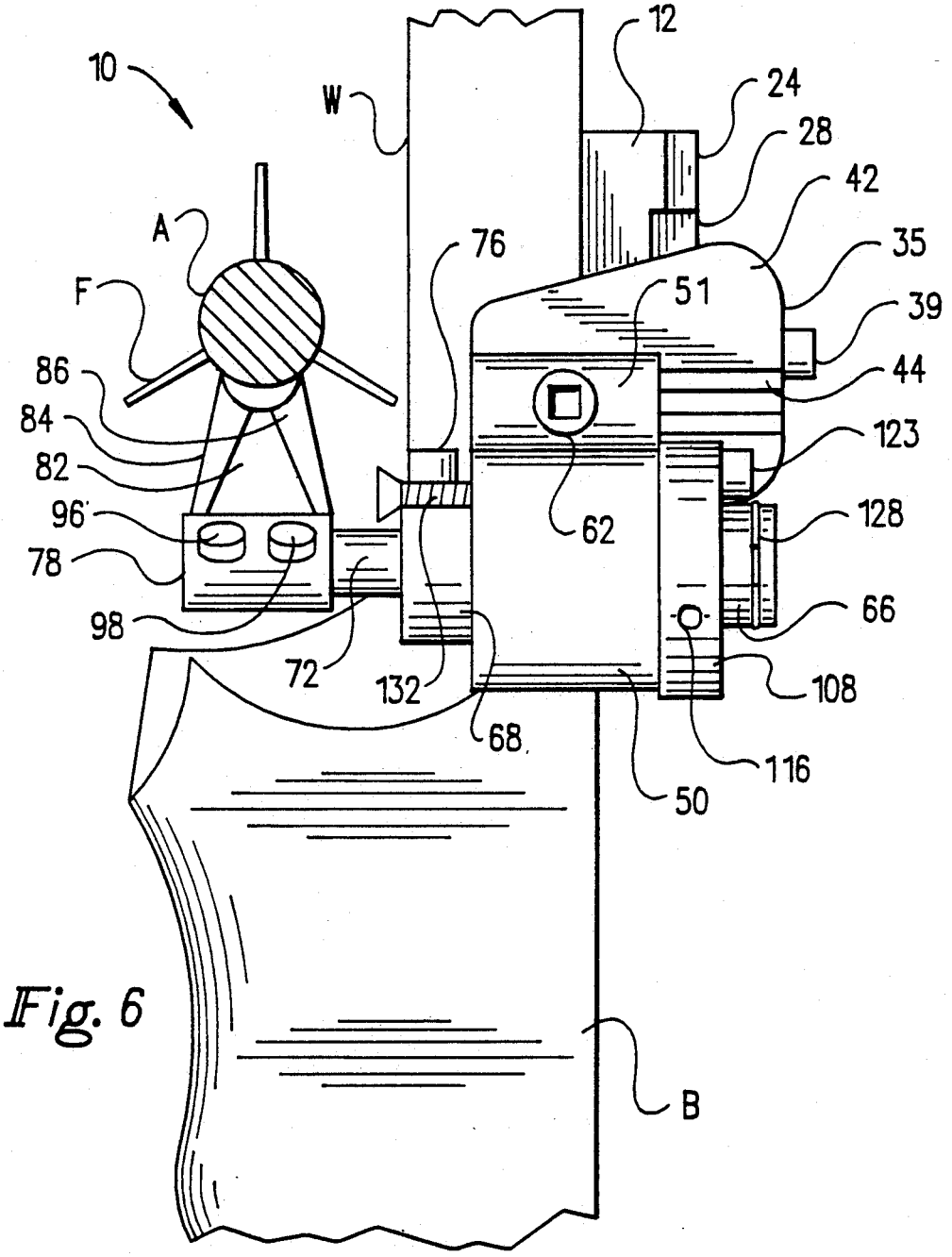
FIG. 6 is a rear elevational view illustrating the adjustable arrow rest of the present invention supporting an arrow and mounted on an archery bow.
Figure 7:
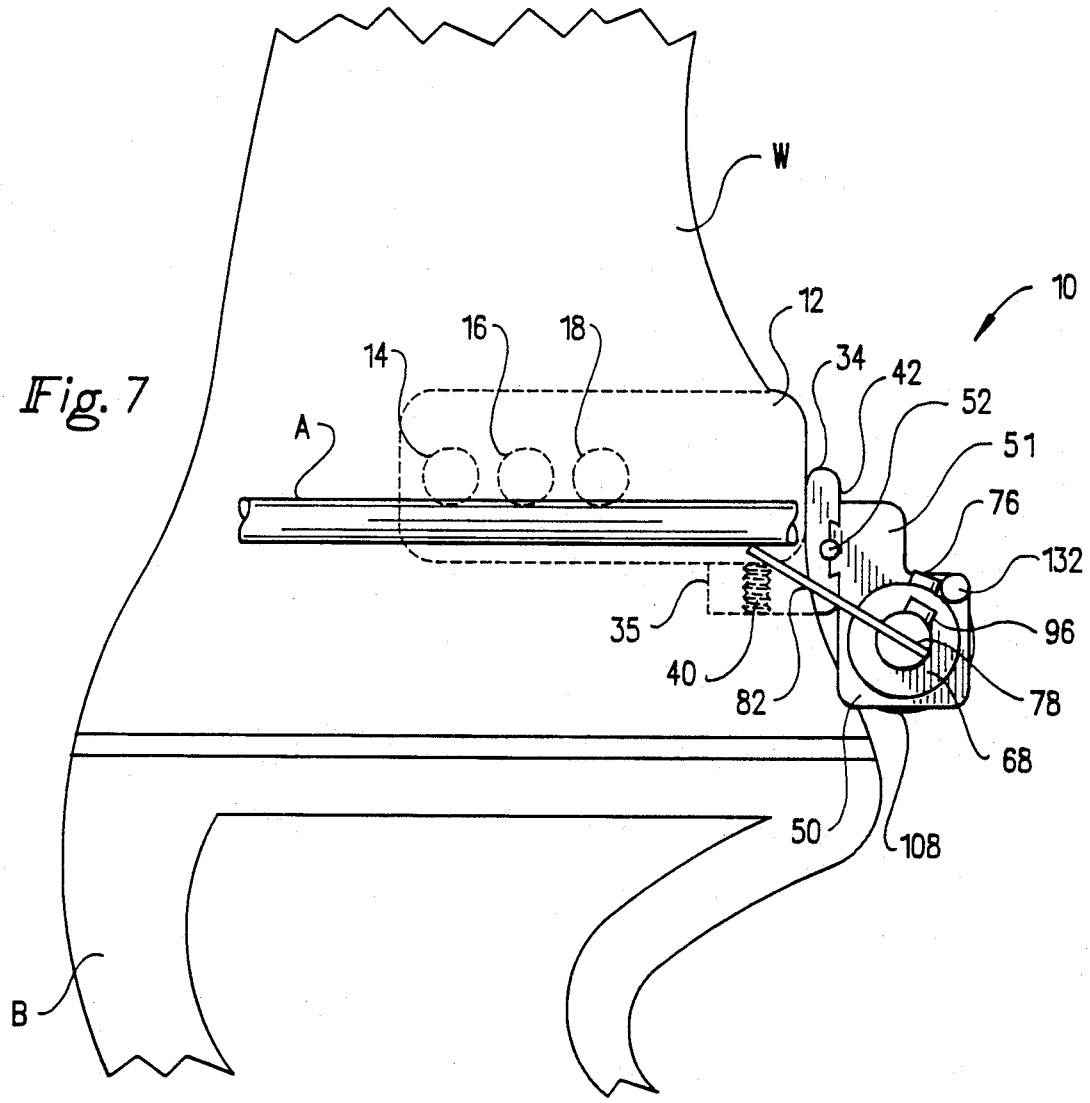
FIG. 7 is a left side elevational view illustrating the adjustable arrow rest of the present invention supporting n arrow in the window of an archery bow.

As may now be understood with reference to FIGS. 1 and 2, the rotary sleeve 66 is mounted for a limited angular displacement about the central longitudinal axis of the arrow rest support shaft 72, against the bias of the torsional coil spring 102. To retain the rotary sleeve 66 in a selected rotational rest position, an exposed stop screw 132 is secured in a threaded aperture 134 formed in a side wall of the housing block 50. As illustrated in FIGS. 6 and 7, abutment of the exposed set screw 76 on the sleeve head portion 68 with the stop screw 132 limits the rotation of the sleeve 66. The stop member 132 may also take the form of an inserted pin, integrally formed projection or similar structure, without departing from the scope of the present invention. In order to effect a coarse positioning of the arrow rest support blade 82, the set screw 76 may be loosened and the arrow rest support shaft 72 may be axially and rotationally adjusted with respect to the sleeve 66. Precise micro adjustment, within the physical limits of the mechanism, of the arrow rest support blade 82 may be effected by rotation of the worm drive screw heads 30 and 53. This allows precise independent adjustment of the arrow rest support blade 82 in vertical and horizontal directions. The restorative spring force of the coil spring 102 (which is effectively, correspondingly embodied as a resistive force or bias of the arrow rest support blade 82) may be adjusted in precise, discrete, repeatable, reregistrable increments by an indexed rotation of the spring adjusting wheel or dial 108.

FIG. 6 illustrates the adjustable arrow rest 10 of the present invention mounted next to the side wall W of a conventional archery bow B. The arrow rest support blade 82 supports an arrow A at a distance from the side wall W sufficient to permit free passage of the arrow feathers or vanes F, when the bow string is released. Upon release of the bow string, a forward force is exerted on the arrow A, which is shot in a direction into the plane of the paper. Such a force causes the arrow shaft to buckle in horizontal or vertical directions or both. Also the arrow might experience archer's paradox due to imperfections in the release of the bowstring and might experience a downward trajectory due to nocking point misalignment. The arrow rest support shaft 72 and attached blade 82 are rotatable in a downward direction, along with the sleeve head portion 68, against the bias of the internal torsional coil spring 102. The downward deflection in effect permits the support blade 82 to move out of the way of the arrow shaft A and arrow vanes or feathers F. Nevertheless, if there is some contact between the arrow shaft and the support blade 82, then the contact will not be abrupt or jarring, but rather, the support blade 82 will resistively cushion the contact. The bias or resistance of the arrow rest support blade 82 helps dampen the vertical oscillations or "porpoising" of the arrow during flight, and the rotational deflection of the arrow rest blade 82 helps to minimize the possibility of, or degree of, striking by the arrow feathers or vanes F against the blade 82. Thus, it should be appreciated that the ability to selectively adjust such bias or resistance helps improve both accuracy and arrow life. Indexed rotation of the adjusting wheel 108 allows adjustment of the rotary spring bias to compensate for different bow weights, different arrow sizes and weights, different arrow support blades, individual technique and a variety of other parameters.

The arrow support position of the blade 82 may be adjusted within the arrow window or on an overdraw bracket in a variety of different ways. The support shaft 72 may be adjusted axially and rotationally with respect to the sleeve head portion 68 by releasing the set screw 76. Precise, micro adjustment of the blade 82 may also be effected independently in vertical and horizontal directions through use of the previously described worm screw drive dovetail mechanisms.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. An adjustable arrow rest, comprising:

a mounting plate;

means for securing said mounting plate to an archery bow;

a slide block;

first guide means mounting said slide block for reciprocal linear movement along a first axis on said mounting plate;

a housing block;

second guide means mounting said housing block for reciprocal linear movement along a second axis on said slide block, said second axis being substantially perpendicular to said first axis, said second guide means operable independently of said first guide means, and said first guide means operable independently of said second guide means;

an arrow rest support member;

an arrow rest arm mounted on said arrow rest support member;

a spring;

means mounting said arrow rest support member for rotation in said housing block against the bias of said spring; and means for selectively adjusting said spring bias.

2. The adjustable arrow rest of claim 1, further comprising means for effecting a linear adjustment of said arrow rest support member with respect to said housing block.

3. The adjustable arrow rest of claim 1, further comprising stop means for retaining said arrow rest support member in a selected adjustable predetermined rotational position.

4. The adjustable arrow rest of claim 1, wherein said means for adjusting said spring bias provides discrete incremental adjustment.

5. The adjustable arrow rest of claim 4, wherein said means for adjusting said spring bias is reregistrable such that the spring bias may be selectively changed from one magnitude to a second, different magnitude and then back to substantially exactly the first magnitude.

6. The adjustable arrow rest of claim 4, wherein said spring bias is reregistrable to at least three different incremental positions.

7. The adjustable arrow rest of claim 6, wherein said increments are substantially uniform.

8. The adjustable arrow rest of claim 4, wherein said arrow rest arm is rotatable on said support member substantially vertically downwardly.

9. The adjustable arrow rest of claim 4, wherein there are at least three discrete increments.

10. The adjustable arrow rest of claim 1, wherein said spring comprises a torsional coil spring.

11. The adjustable arrow rest of claim 10, wherein said means for adjusting said spring bias includes means for winding said torsional coil spring

12. The adjustable arrow rest of claim 11, wherein said torsional coil spring is wound in discrete angular increments.

13. The adjustable arrow rest of claim 1, wherein at least one of said first and second guide means includes first and second mating dovetail guide members.

14. The adjustable arrow rest of claim 13, further comprising:

one of said first and second dovetail guide members having a first elongated central semi-cylindrical recess divided by a recessed slot;

the other of said first and second dovetail guide members having a second elongated central semi-cylindrical recess including a larger diameter portion and a smaller diameter threaded portion;

said first and second semi-cylindrical recesses disposed in alignment and forming a generally cylindrical bore; and a worm drive screw having an enlarged head captured in said recessed slot and a threaded portion disposed in engagement with said threaded portion of said second semi-cylindrical recess, such that rotation of said worm drive screw effects relative linear movement of said first and second dovetail guide members.

15. The adjustable arrow rest of claim 14, further comprising:

a transverse threaded aperture formed through one of said first and second dovetail guide members in a direction perpendicular to said worm drive screw;

a packing disk formed from a deformable material in said transverse aperture and disposed in abutment with threads of said worm drive screw; and a set screw in said threaded transverse aperture for urging said packing disk into abutment with said worm drive screw and securing said first and second dovetail guide members in a selected adjusted position.

16. In an adjustable arrow rest having two linearly adjustable portions secured by first and second mating guide members, the improvement comprising:

one of said first and second guide members having a first elongated central semi-cylindrical recess divided by a recessed slot;

the other of said first and second guide members having a second elongated central semi-cylindrical recess including a larger diameter portion and a smaller diameter threaded portion;

said first and second semi-cylindrical recesses disposed in alignment and forming a generally cylindrical bore; and a worm drive screw having an enlarged head captured in said recessed slot and a threaded portion disposed in engagement with said threaded portion of said second semi-cylindrical recess, such that rotation of said worm drive screw effects relative linear movement of said first and second guide members.

17. The adjustable arrow rest of claim 16, further comprising:

a transverse threaded aperture formed through one of said first and second guide members in a direction perpendicular to said worm drive screw;

a packing disk formed from a deformable material in said transverse aperture and disposed in abutment with threads of said worm drive screw; and a set screw in said threaded transverse aperture for urging said packing disk into abutment with said worm drive screw and securing said first and second guide members in a selected adjusted position.

18. An archery arrow rest, comprising:

an arm adapted to support an arrow shaft;

a rotationally mounted sleeve;

a support shaft secured to said arm, said support shaft secured in substantially coaxial relation within said sleeve for concurrent rotation therewith;

means for mounting said sleeve to an archery bow;

means for permitting rotational displacement of said sleeve from a first position to an other position during flight of an arrow;

a torsional coil spring surrounding said sleeve and operably connected for applying a rotary biasing force to said sleeve urging said sleeve from said other position toward said first position; and a dial mounted on said sleeve for selective rotation relative thereto, said dial operably connected for selectively winding said torsional coil spring to selectively adjust said biasing force.

19. The archery arrow rest of claim 18, further comprising means for indexing said dial in a plurality of discrete angular increments.

20. An adjustable arrow rest for use with an archery bow, comprising:

a mounting plate;

three threaded apertures formed through said mounting plate and disposed in linear array;

one of said apertures receiving a spring biased plunger screw dimensioned for threaded engagement with a bow;

a pair of set screws received in two of said apertures for clamping abutment with a bow to secure said mounting plate thereon;

a first dovetail guide member formed adjacent one end of said mounting plate;

an L-shaped slide block having first and second leg portions;

a second dovetail guide member formed on said first leg portion of said L-shaped slide block, said second dovetail guide member disposed in mating engagement with said first dovetail guide member and mounting said L-shaped slide block for reciprocal linear movement along a first axis;

one of said first and second dovetail guide members having a first elongated central semi-cylindrical recess divided by a first recessed slot;

the other of said first and second dovetail guide members having a second elongated central semi-cylindrical recess including a larger diameter portion and a smaller diameter threaded portion;

said first and second semi-cylindrical recesses disposed in alignment and forming a generally cylindrical bore;

a first worm drive screw having an enlarged head captured in said first recessed slot and a threaded portion disposed in engagement with said threaded portion of said second semi-cylindrical recess, such that rotation of said first worm drive screw moves said L-shaped block along said first axis;

a first transverse aperture formed through one of said first and second dovetail guide members in a direction perpendicular to said first worm drive screw;

a first deformable packing disk in said first transverse aperture and disposed in abutment with threads of said first worm drive screw;

a set screw in said first transverse aperture for urging said first packing disk into abutment with said first worm drive screw and securing said first and second dovetail guide members in a selected adjusted position;

a third dovetail guide member formed on said second leg portion of said L-shaped slide block;

a housing block including an extension portion;

a fourth dovetail guide member formed on said extension portion of said housing block, said fourth dovetail guide member disposed in mating engagement with said third dovetail guide member and mounting said housing block for reciprocal linear movement along a second axis perpendicular to said first axis;

one of said third and fourth dovetail guide members having a third elongated central semi-cylindrical recess divided by a second recessed slot;

the other of said third and fourth dovetail guide members having a fourth elongated central semi-cylindrical recess including a larger diameter portion and a smaller diameter threaded portion;

said third and fourth semi-cylindrical recesses disposed in alignment and forming a generally cylindrical bore;

a second worm drive screw having an enlarged head captured in said second recessed slot and a threaded portion disposed in engagement with said threaded portion of said fourth semi-cylindrical recess, such that rotation of said second worm drive screw moves said housing block along said second axis;

a second transverse aperture formed through one of said third and fourth dovetail guide members in a direction perpendicular to said second worm drive screw;

a second deformable packing disk in said second transverse aperture and disposed in abutment with threads of said second worm drive screw;

a set screw in said second transverse aperture for urging said second packing disk into abutment with said second worm drive screw and securing said third and fourth dovetail guide members in a selected adjusted position;

a cylindrical bore formed through said housing block;

a rotary sleeve received for rotation in said cylindrical bore in said housing block;

an axial bore extending through said sleeve;

an arrow rest support shaft received within said axial bore in said sleeve;

an outwardly projecting set screw extending through a transverse threaded aperture in said sleeve and into abutment with said arrow rest support shaft for securing said arrow rest support shaft in a selected axially and rotationally adjusted position with respect to said sleeve;

an arrow rest secured to an outer end portion of said arrow rest support shaft;

a torsional coil spring surrounding said rotary sleeve and disposed within said cylindrical bore in said housing block;

said torsional coil spring having a right angular free end portion received within a transverse aperture in said rotary sleeve;

a spring adjusting wheel having a reduced diameter bushing portion received within said cylindrical bore in said housing block;

said rotary sleeve received for rotation in an axial bore formed through said spring adjusting wheel;

a plurality of threaded apertures disposed in said housing block in a circular array about said cylindrical bore in said housing block;

said torsional coil spring having a straight free end opposite said right angular free end received within an aperture in said spring adjusting wheel and secured therein by a set screw, such that said rotary sleeve is provided with a rotational spring bias;

a rotary stop screw extending from said housing block and disposed for abutment with said projecting set screw in said rotary sleeve for retaining said rotary sleeve in a predetermined rotational position;

a pair of index apertures formed through said spring adjusting wheel in alignment with two of said plurality of threaded apertures in said housing block;

a locating pin received in one of said index apertures in said spring adjusting wheel and in a selected one of said plurality of threaded apertures in said housing block; and a clamping screw received through one of said index apertures in said spring adjusting wheel and in engagement with one of said plurality of threaded apertures in said housing block whereby rotary spring bias of said torsional coil spring may be adjusted in discrete increments.

21. An adjustable arrow rest, comprising:

a mounting plate;

means for securing said mounting plate to an archery bow;

a slide block;

first guide means mounting said slide block for reciprocal linear movement along a first axis on said mounting plate;

a housing block;

second guide means mounting said housing block for reciprocal linear movement along a second axis on said slide block, said second axis being substantially perpendicular to said first axis, said second guide means operable independently of said first guide means, and said first guide means operable independently of said second guide means;

an arrow rest support member;

an arrow rest arm mounted on said arrow rest support member;

a spring; and means mounting said arrow rest support member for rotation in said housing block against the bias of said spring.

22. The adjustable arrow rest of claim 21, further comprising means for adjusting said spring bias.

23. The adjustable arrow rest of claim 22, wherein said means for adjusting said spring bias is reregistrable such that the spring bias may be selectively changed from one magnitude to a second, different magnitude and then back to substantially exactly the first magnitude.

24. The adjustable arrow rest of claim 23, wherein said spring bias is reregistrable to at least six different incremental positions.

25. The adjustable arrow rest of claim 24, wherein said increments are substantially uniform.

26. The adjustable arrow rest of claim 21, further comprising stop means for retaining said arrow rest support member in a selected adjustable predetermined rotational position.

27. The adjustable arrow rest of claim 21, wherein said spring comprises a torsional coil spring.

28. The adjustable arrow rest of claim 27, further comprising means for winding said torsional coil spring to adjust said spring bias.

29. The adjustable arrow rest of claim 28, wherein said torsional coil spring is wound in discrete angular increments.

30. The adjustable arrow rest of claim 21, wherein said arrow rest arm is rotatable on said arrow rest support member substantially vertically downwardly.

31. The adjustable arrow rest of claim 21, wherein at least one of said first and second guide means comprise cooperating dovetail members.

32. The adjustable arrow rest of claim 21, wherein each of said first and second guide means comprise cooperating dovetail members.

33. A combination comprising:

an archery bow having a bow handle portion including an arrow window substantially defined by a substantially horizontal bow shelf and a substantially vertical sidewall;

an arrow rest arm disposed substantially in said arrow window substantially above said horizontal bow shelf and spaced from said vertical sidewall a distance sufficient to permit the free passage of an arrow feather therebetween;

a mounting plate;

means securing said mounting plate to said archery bow;

a slide block;

first guide means mounting said slide block for reciprocal linear movement along a first axis on said mounting plate;

a housing block;

second guide means mounting said housing block for reciprocal linear movement along a second axis on said slide block, said second axis being substantially perpendicular to said first axis, said second guide means operable independently of said first guide means, and said first guide means operable independently of said second guide means;

a spring associated with said housing block;

means mounting said arrow rest arm on said housing block for substantially vertically downward rotation of said arm about a substantially horizontal axis against the bias of said spring; and means for selectively adjusting said spring bias.

34. The combination of claim 33, further comprising stop means for retaining said arrow rest arm in a selected adjusted predetermined rotational position.

35. The combination of claim 33, wherein said means for adjusting said spring bias includes means providing discrete incremental adjustment.

36. The combination of claim 33, wherein said means for adjusting said spring bias is reregistrable such that the spring bias may be selectively changed from one magnitude to a second, different magnitude and then, back to substantially exactly the first magnitude.

37. The combination of claim 36, wherein said spring bias is reregistrable to at least six different incremental positions.

38. The combination of claim 37, wherein said incremental positions are substantially uniform.

39. The combination of claim 36, wherein said spring comprises a torsional coil spring.

40. The combination of claim 39, wherein said means for adjusting said spring bias includes means for winding said torsional coil spring.

41. The combination of claim 40, wherein said torsional coil spring is wound in discrete angular increments.

42. The combination of claim 41, wherein there are at least three discrete increments.

43. In an archer arrow rest possessing two linearly adjustable portions secured by first and second mating guide members, the improvement comprising:

a transverse threaded aperture formed through one of said first and second guide members in a direction substantially perpendicular to the direction of linear adjustment;

a worm drive screw operatively associated with said first and second mating guide members for effecting linear adjustment;

a packing disk formed from a deformable material in said transverse aperture and disposed in abutment with threads of said worm guide screw; and a set screw in said threaded transverse aperture for urging said packing disk into abutment with said worm drive screw and securing said first and second guide members in a selected position.

44. The adjustable arrow rest of claim 43, wherein said first and second guide members comprise cooperating male and female dovetail members.

45. An adjustable arrow rest for use with an archery bow, comprising:

a mounting plate;

means for securing said mounting plate to an archery bow;

a first guide member formed adjacent one end of said mounting plate;

a substantially L-shaped slide block including first and second leg portions;

a second guide member formed on said first leg portion of said slide block, said second guide member disposed in mating engagement with said first guide member and mounting said slide block for reciprocal linear movement along a first axis;

a third guide member formed on said second leg portion of said slide block;

a housing block including an extension portion;

a fourth guide member formed on said extension portion of said housing block, said fourth guide member disposed in mating engagement with said third guide member and mounting said housing block for reciprocal linear movement along a second axis substantially perpendicular to said first axis; and an arrow rest connected to said housing block.

46. The adjustable arrow rest of claim 45, further comprising:

a support shaft secured to said arrow rest; and means rotatably mounting said support shaft to said housing block for displacement from a first position to an other position during flight of an arrow.

47. The adjustable arrow rest of claim 46, further comprising:

a spring operably connected for applying a rotary restorative force to said support shaft urging said support shaft from said other position to said first position.

48. The adjustable arrow rest of claim 47, further comprising:

a cylindrical bore formed through said housing block;

a rotary sleeve received for rotation in said cylindrical bore in said housing block;

an axial bore extending through said sleeve; and said support shaft received within said axial bore in said sleeve.

49. The adjustable arrow rest of claim 48, further comprising an outwardly projecting set screw extending through a transverse threaded aperture in said sleeve and into abutment with said support shaft for securing said support shaft in a selected axially and rotationally adjusted position with respect to said sleeve.

50. The adjustable arrow rest of claim 49 further comprising a rotary stop screw extending from said housing block and disposed for abutment with said projecting set screw in said rotary sleeve for retaining said rotary sleeve in a predetermined rotational position.

51. The adjustable arrow rest of claim 48, wherein said spring comprises a torsional coil spring surrounding said rotary sleeve and disposed with said cylindrical bore in said housing block.

52. The adjustable arrow rest of claim 51, wherein said torsional coil spring possesses a right angular free end portion received within a transverse aperture in said rotary sleeve.

53. The adjustable arrow rest of claim 51, further comprising a spring adjusting wheel having a reduced diameter bushing portion received within said cylindrical bore in said housing block and operably connected for winding said torsional coil spring to adjust the spring bias.

54. The adjustable arrow rest of claim 53, wherein sleeve is received for rotation in an axial bore formed through said spring adjusting wheel.

55. The adjustable arrow rest of claim 54, further comprising:

a plurality of threaded apertures disposed in said housing block in a circular array about said cylindrical bore in said housing block;

a pair of index apertures formed through said spring adjusting wheel in alignment with two of said plurality of threaded apertures in said housing block; and a locking pin received in one of said index apertures in said spring adjusting wheel and in a selected one of said plurality of threaded apertures in said housing block.

56. The adjustable arrow rest of claim 55, further comprising a clamping screw received through one of said index apertures in said spring adjusting wheel and in engagement with one of said plurality of threaded apertures in said housing block whereby the rotary spring bias of said torsional coil spring may be adjusted in discrete increments.

57. The adjustable arrow rest of claim 53 wherein said torsional coil spring possesses a straight free end received within an aperture in said spring adjusting wheel and secured therein by a set screw, such that said rotary sleeve is provided with a rotational spring bias.

58. The adjustable arrow rest of claim 45 further comprising:

one of said first and second guide members possessing a first elongated central semi-cylindrical recess divided by a recessed slot;

the other of said first and second guide members having a second elongated central semi-cylindrical recess including a larger diameter portion and a smaller diameter threaded portion;

said first and second semi-cylindrical recesses disposed in alignment and forming a generally cylindrical bore; and a worm drive screw having an enlarged head captured in said first recessed slot and a threaded portion disposed in engagement with said threaded portion of said second semi-cylindrical recess, such that rotation of said first worm drive screw moves said L-shaped block along said first axis.

59. The adjustable arrow rest of claim 58, further comprising:

a transverse aperture formed through one of said first and second guide members in a direction perpendicular to said worm drive screw;

a deformable packing disk in said transverse aperture and disposed in abutment with threads of said worm drive screw; and a set screw in said transverse aperture for urging said packing disk into abutment with said worm drive screw and securing said first and second guide members in a selected adjusted position.

60. The adjustable arrow rest of claim 45, further comprising:

one of said third and fourth guide members having a first elongated central semi-cylindrical recess divided by a recessed slot;

the other of said third and fourth guide members having a second elongated central semi-cylindrical recess including a larger diameter portion and a smaller diameter threaded portion;

said first and second semi-cylindrical recessed disposed in alignment and forming a generally cylindrical bore; and a worm drive screw having an enlarged head captured in said recessed slot and a threaded portion disposed in engagement with said threaded portion of said second semi-cylindrical recess, such that rotation of said worm drive screw moves said housing block along said second axis.

61. The adjustable arrow rest of claim 60, further comprising:

a transverse aperture formed through one of said third and fourth guide members in a direction perpendicular to said second worm drive screw;

a deformable packing disk in said transverse aperture and disposed in abutment with threads of said worm drive screw; and a set screw in said transverse aperture for urging said packing disk into abutment with said worm drive screw and securing said third and fourth guide members in a selected adjusted position.

62. An archery arrow rest, comprising:

an arm adapted to support an arrow shaft;

a rotationally mounted sleeve;

a support shaft secured to said arm, said support shaft secured in substantially coaxial relation within said sleeve for concurrent rotation therewith;

means for mounting said sleeve to an archery bow;

means for permitting rotational displacement of said sleeve from a first position to an other position during flight of an arrow;

a torsional coil spring operably connected for applying a rotary biasing force to said sleeve urging said sleeve from said other position toward said first position;

a rotary dial for selectively winding said torsional coil spring to selectively adjust said biasing force; and a plurality of circumferentially spaced apertures and at least one cooperating locating member for indexably adjusting said rotary dial in discrete angular increments.

63. The archery arrow rest of claim 62, further comprising a threaded clamping screw for engagement with said dial and one of said plurality of circumferentially spaced apertures to secure said dial in a selected adjusted position.

64. The archer arrow rest of claim 62, wherein said torsional coil spring surrounds said sleeve.

65. The archery arrow rest of claim 62, wherein said rotary dial is mounted for selective rotation on, and relative to, said sleeve.

66. The archery arrow rest of claim 65, wherein said spring has a first free end secured to said sleeve and a second free end secured to said rotary dial.

* * * * *